US008519814B2

(12) United States Patent
Feng et al.

(10) Patent No.: US 8,519,814 B2
(45) Date of Patent: Aug. 27, 2013

(54) SWITCHABLE TRANSFORMER WITH EMBEDDED SWITCHES INSIDE THE WINDINGS

(75) Inventors: Lei Feng, Hillsboro, OR (US); Chi D. Chu, Hillsboro, OR (US); Ram Sadhwani, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 13/250,934

(22) Filed: Sep. 30, 2011

(65) Prior Publication Data

US 2013/0082810 A1 Apr. 4, 2013

(51) Int. Cl.

| | |
|---|---|
| ***H01F 21/02*** | (2006.01) |
| ***H01F 29/06*** | (2006.01) |
| ***H01F 27/28*** | (2006.01) |
| ***H01F 5/00*** | (2006.01) |

(52) U.S. Cl.

USPC ..... 336/145; 336/140; 336/170; 336/200; 336/232

(58) Field of Classification Search

USPC ..... 336/138–150, 200, 232, 170, 180, 336/182; 455/121, 292, 129, 280, 338; 333/32, 333/25, 132, 26; 361/736, 749; 257/531

See application file for complete search history.

(56) References Cited

U.S. PATENT DOCUMENTS

| | | | | |
|---|---|---|---|---|
| 6,707,367 | B2 * | 3/2004 | Castaneda et al. | 336/200 |
| 7,010,279 | B2 * | 3/2006 | Rofougaran | 455/121 |
| 7,248,844 | B2 * | 7/2007 | Rofougaran | 455/117 |
| 7,259,649 | B2 * | 8/2007 | Ancey et al. | 336/200 |
| 7,526,256 | B2 * | 4/2009 | Bhatti et al. | 455/73 |
| 7,683,851 | B2 * | 3/2010 | Rofougaran et al. | 343/850 |
| 7,880,547 | B2 | 2/2011 | Lee et al. | |
| 7,890,066 | B2 * | 2/2011 | Rofougaran | 455/117 |
| 7,924,135 | B2 | 4/2011 | Chen et al. | |
| 7,940,152 | B1 | 5/2011 | Kim et al. | |
| 8,279,018 | B1 * | 10/2012 | Song et al. | 333/25 |
| 2008/0253149 | A1 | 10/2008 | Matumoto | |
| 2010/0109798 | A1 * | 5/2010 | Chu | 333/124 |
| 2010/0201457 | A1 * | 8/2010 | Lee et al. | 333/117 |
| 2011/0043316 | A1 | 2/2011 | Yang et al. | |

FOREIGN PATENT DOCUMENTS

| | | | |
|---|---|---|---|
| WO | 2013048908 | A1 | 4/2013 |

OTHER PUBLICATIONS

International Search Report and written opinion received for PCT Patent Application No. PCT/US2012/056682, mailed on Mar. 4, 2013, 9 pages.

* cited by examiner

*Primary Examiner* — Mohamad Musleh
*Assistant Examiner* — Mangtin Lian
(74) *Attorney, Agent, or Firm* — Carrie A. Boone, P.C.

(57) ABSTRACT

A switchable transformer architecture is disclosed. The switchable transformer includes a primary winding, a secondary winding, and a tertiary winding, in which either the secondary winding or the tertiary winding establish a signal path to the primary winding, based on the position of switches, enabling transmission to either of two blocks sharing the transformer. The transformer architecture achieves high isolation between sharing blocks and low loss on the signal path.

20 Claims, 9 Drawing Sheets current flow in the secondary

SWITCHABLE TRANSFORMER WITH EMBEDDED SWITCHES INSIDE THE WINDINGS

TECHNICAL FIELD

This application relates to transformers and, more particularly, to transformers working with switches to control signal flow.

BACKGROUND

Transformers and switches are widely used in modern radio frequency (RF) transceiver design to control signal flow. In a multi-port system, the combination of transformers and switches may establish signal flow between certain ports, while keeping other ports isolated. A widely seen example is the transformers plus the transmitter/receiver switch for antenna sharing in an RF transceiver. To enable multiple circuit blocks sharing the antenna, RF switches are put around transformers and antennas to control the antenna ownership by the circuit blocks. When the switch is in a first position, the antenna is connected to the transmitter, allowing the transmitter to send signals to a remote receiver. When the switch is in a second position, the antenna is connected to the receiver, allowing the receiver to receive signal sent by a remote transmitter.

BRIEF DESCRIPTION OF THE DRAWINGS

The foregoing aspects and many of the attendant advantages of this document will become more readily appreciated as the same becomes better understood by reference to the following detailed description, when taken in conjunction with the accompanying drawings, wherein like reference numerals refer to like parts throughout the various views, unless otherwise specified.

DETAILED DESCRIPTION

In accordance with the embodiments described herein, a switchable transformer architecture is disclosed. The switchable transformer includes a primary winding, a secondary winding, and a tertiary winding, in which either the secondary winding or the tertiary winding or both may establish a signal path to the primary winding, based on the position of switches. The transformer architecture achieves high isolation between the secondary and the tertiary windings and low loss on the signal path.

In the following detailed description, reference is made to the accompanying drawings, which show by way of illustration specific embodiments in which the subject matter described herein may be practiced. However, it is to be understood that other embodiments will become apparent to those of ordinary skill in the art upon reading this disclosure. The following detailed description is, therefore, not to be construed in a limiting sense, as the scope of the subject matter is defined by the claims.

Figure 1:
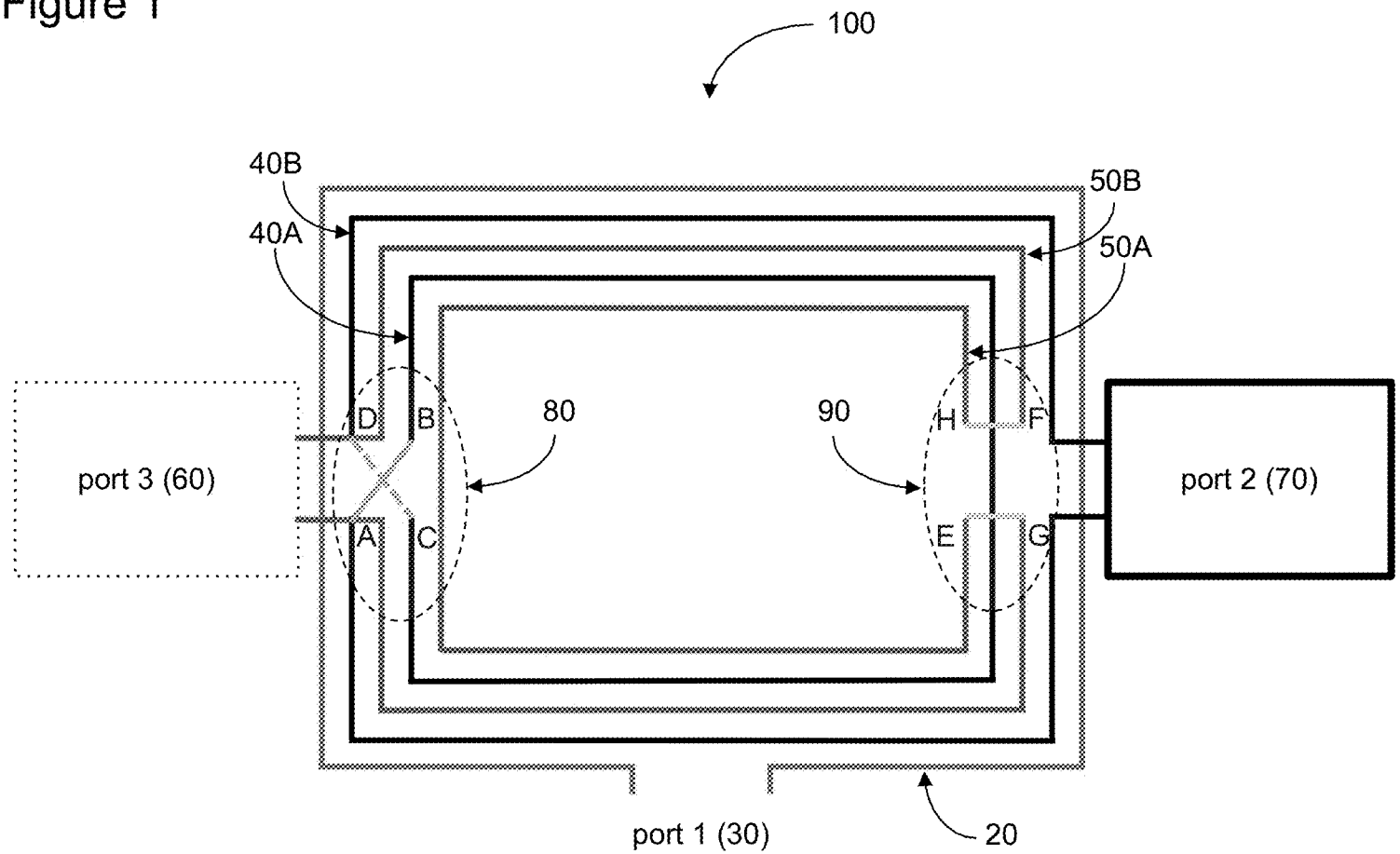
FIG. 1 is a schematic diagram of a switchable transformer where the port 2 switch is turned on and the port 3 switch is turned off, according to some embodiments.
Figure 2:
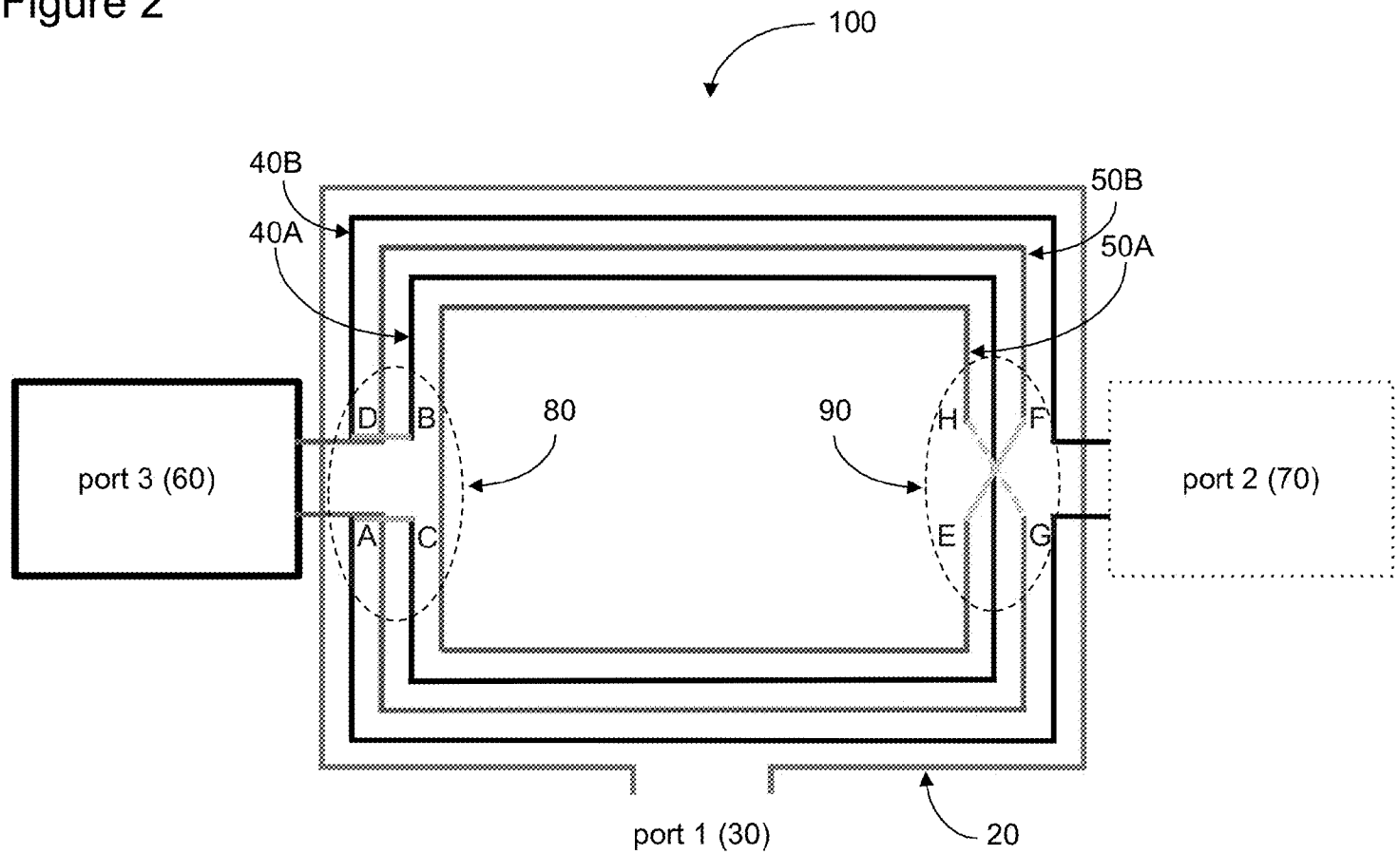
FIG. 2 is a schematic diagram of the switchable transformer of FIG. 1 where the port 2 switch is turned off and the port 3 switch is turned on, according to some embodiments.

FIGS. 1 and 2 are schematic block diagrams of a novel switchable transformer architecture 100, according to some embodiments. In the following depictions, a simplified architecture is depicted, with the transformer having one- and two-turn windings, for ease of illustrating the concepts herein. Nevertheless, the principles explained in the following pages and in the drawings may readily be applied to transformers of a more complex nature.

In FIGS. 1 and 2, the transformer 100 has a 1:2 turn ratio, meaning that the number of turns in the primary portion of the transformer (primary) is half the number of turns in the secondary portion of the transformer (secondary). This transformer 100 also has two secondary windings, deemed secondary and tertiary, in which only one of the two windings has a high coupling coefficient with the primary winding, in some embodiments. The transformer 100 includes a single-turn primary winding 20 (also known herein as a primary 20), a two-turn secondary winding 40, with a first turn 40A and a second turn 40B (known collectively as the secondary 40), and a two-turn tertiary winding 50, with a first turn 50A and a second turn 50B (known collectively as the tertiary 50). The windings are color-coded for ease of understanding, with the primary 20 being blue, the secondary 40 being black, and the tertiary 50 being red.

The primary 20 (blue) is connected to port 1 30. The secondary (black) is connected to port 2 70. The tertiary (red) is connected to port 3 60. In some embodiments, only one of port 2 and port 3 may establish a signal path to port 1. The other port is isolated so that no signal flows to it. Thus, either the port 3 60 or the port 2 70 establishes a signal path to port 1, but not both. In FIG. 1, the port 2 70 establishes a signal path with port 1 (the thick black lines surrounding port 2 denotes that port 2 is "active" while the dotted lines surrounding port 3 denote that port 3 is "inactive). Conversely, in FIG. 2, the port 3 60 establishes the signal path with port 1 while no signal path is established with port 2 (port 2 in dotted lines, port 3 in thick black lines).

The novel transformer 100 further includes a pair of switches 80, 90, for controlling whether the port 3 60 or the port 2 70 establishes the signal path to port 1 30. In FIG. 1, the switch 80 (green), also known herein as the port 2 switch 80, is shown as a cross, with points A and B being connected together and points C and D being connected together. (The connection between C and D is dashed to indicate that the connection between C and D are not connected to the solid line between A and B.) In this configuration, the port 2 switch 80 is considered on. In FIG. 2, by contrast, the port 2 switch 80 (green) is shown as two parallel lines, with points A and C being connected together and points B and D being connected together. In this configuration, the port 2 switch 80 is considered off.

Similarly, the switch 90 that enables an output to port 3 60 may be configured in one of two ways. In FIG. 1, the switch 90 (yellow), also known herein as the port 3 switch 90, is shown as two parallel lines, with points H and F being connected together and points E and G being connected together. In this configuration, the port 3 switch 90 is considered off. In FIG. 2, the port 3 switch 90 (yellow) is shown as a cross, with points H and G being connected together and points E and F being connected together. In this configuration, the port 3 switch 90 is considered on. As is described in more detail, below, the configuration of these switches 80, 90 vary the behavior of the transformer 100 and control whether the port 3 60 or the port 2 70 is establishing a signal link to port 1 30.

In some embodiments, the port 2 switch 80 and the port 3 switch 90 enable the transformer 100 to achieve high isolation between the two ports (i.e., the port 3 60 and the port 2 70) and low loss on the signal path, established between port 1 30 and either the port 2 70 or the port 3 60. The high isolation is due to coupling cancellation while the low loss is due to reduced voltage swing across the switches 80, 90, so that a low-voltage device may be used. Further, the architecture 100 is area-efficient since a single transformer is servicing both the port 2 70 and the port 3 60. In some embodiments, a transmitter is connected to the port 2 70 while a receiver is connected to the port 3. Using the transformer architecture 100, the transmitter and receiver may be selectively enabled.

Figure 3:
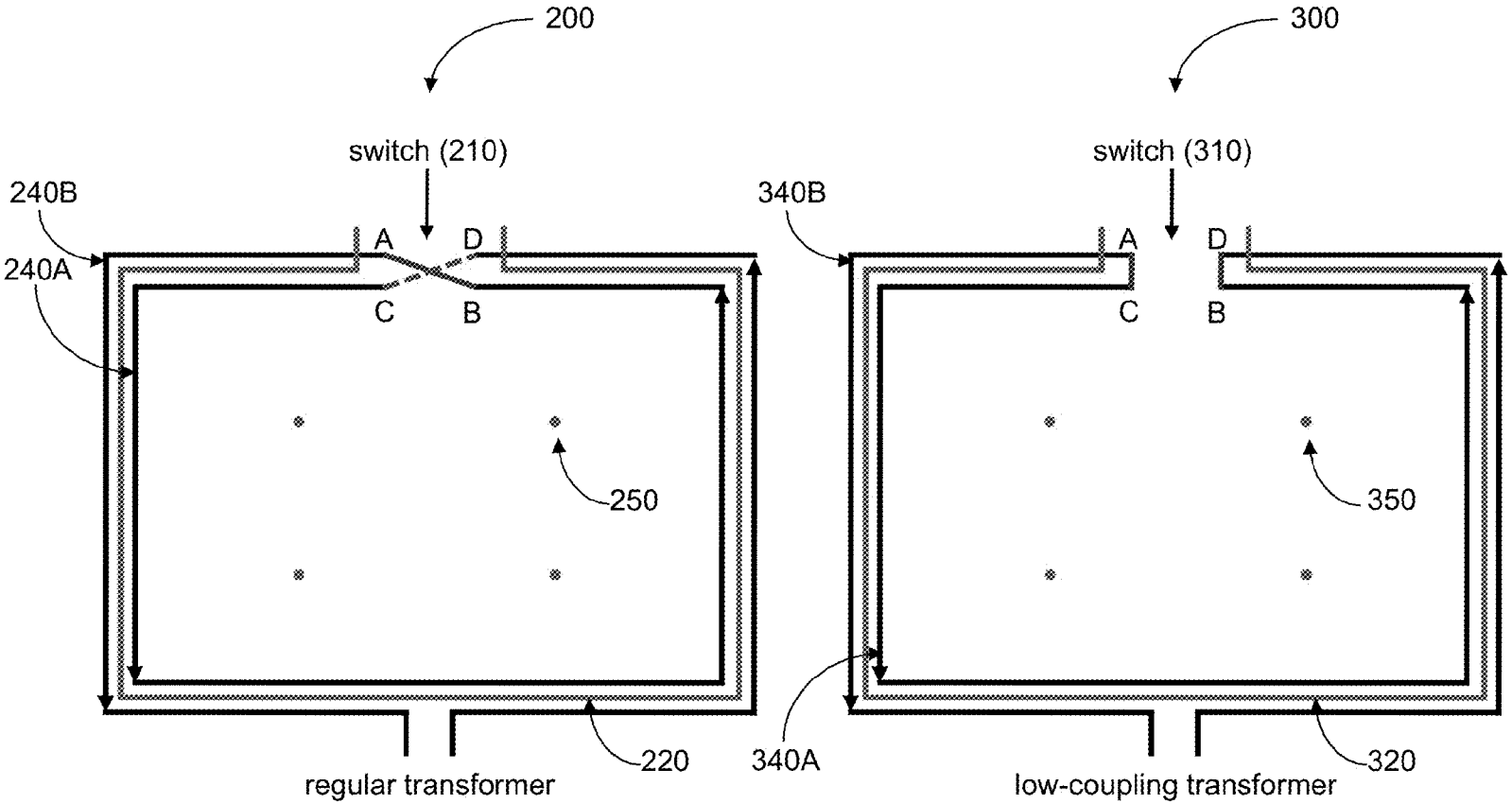
FIG. 3 is a schematic diagram of a regular transformer and a low-coupling transformer, according to some embodiments.

In some embodiments, the switchable transformer architecture 100 is designed to control the transformer so that it may perform either as a regular high-coupling transformer or as a low-coupling transformer. The idea is illustrated in FIG. 3, which depicts two transformers 200, 300. For ease of understanding, each transformer has a 1:2 turn ratio. Each transformer 200, 300 has a single-turn primary inductor or winding 220, 320 (red) and a two-turn secondary inductor or winding (black), with a first winding 240A, 340A and a second winding 240B, 340B (collectively, secondary 240, 340).

Figure 4:
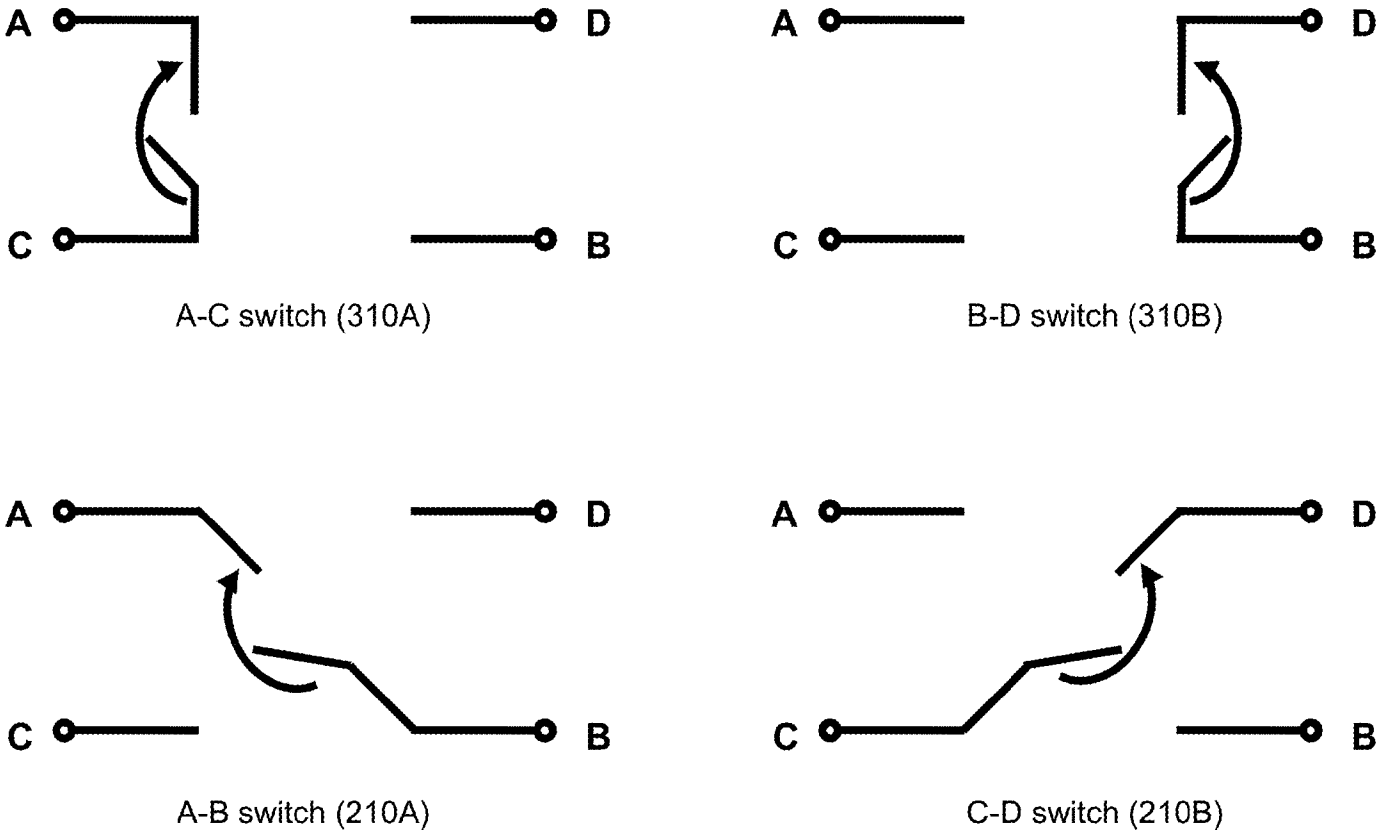
FIG. 4 is a diagram of switch positions used by the port 3 switch and port 2 switch of the switchable transformer of FIG. 1, according to some embodiments.

The transformer 200 is a regular transformer that includes a switch 210, with the arrangement of connections formed by the switch looking in the schematic illustration like a cross (A connected to B, and C connected to D). Although depicted as a single switch, the switch 210 may consist of multiple switches that achieve the A-B and C-D connections shown. FIG. 4 shows two switches 210A and 210B that would be engaged to result in the connections shown in FIG. 3.

The transformer 300 is a low-coupling transformer that includes a switch 310, with the arrangement of connections formed by the switch looking in the schematic illustration like two parallel lines (A connected to C, and B connected to D). Again, although depicted as a single switch, the switch 310 consists of multiple switches that achieve the A-C and B-D connections shown. FIG. 4 shows two switches 310A and 310B that would be engaged to result in the connections shown in FIG. 3.

As is well-known, transformers consist of a primary winding and a second winding. A current coming into the primary winding induces a magnetic field that, in turn, generates the current so that power is transferred from the primary winding to the secondary winding. In the two transformers 200, 300 of FIG. 3, the magnetic field 250, 350 is depicted as emerging out of the surface, which, in the two-dimensional drawing, appears as a dot. The magnetic field 250 is orthogonal to the current flowing in the primary 220 of the regular transformer 200; similarly, the magnetic field 350 is orthogonal to the current flowing in the primary 320 of the low-coupling transformer 300.

Arrows are used to depict the resulting flow of current in the secondary. In both the regular transformer 200 and in the low-coupling transformer 300, the arrows are counter-clockwise in their direction, due to the out-of-surface direction of the magnetic fields 250, 350.

The transformer 200 achieves a high coupling coefficient between the primary (red) and the secondary (black). This is because the current flowing in the inner turn 240A of the secondary winding is in the same direction as the current flowing in the outer turn 240B of the secondary winding (additive current flow). The transformer 300, by contrast, is a low-coupling transformer because the current flowing in the inner turn 340A of the secondary winding is flowing in the opposite direction as the current flowing in the outer turn 340B of the secondary winding (subtractive or opposite current flow), thus having the effect of cancelling out much of the current in the secondary. Thus, in the low-coupling transformer 300, the two currents will mostly cancel each other out, which results in a low coupling coefficient between the primary and the secondary. It is the distinct differences between the operations of these two transformers 200 and 300 that motivates the design of the switchable transformer 100.

Returning to FIGS. 1 and 2, the transformer 100, in essence, combines the features of the regular transformer 200 and the low-coupling transformer 300, by having two possible secondary outputs (deemed secondary and tertiary). The primary 20 connected to the port 1 30 is blue, the secondary 40 connected to the port 2 is black, and the tertiary 60 connected to the port 3 is red.

When the port 2 switch 80 is in the configuration of FIG. 1 (turned on), the secondary winding (black) operates as the regular transformer 200 of FIG. 3; when the switch 80 is in the configuration of FIG. 2 (turned off), the secondary winding operates as the low-coupling transformer 300. When the port 3 switch 90 is in the configuration of FIG. 1 (turned off), the tertiary winding (red) operates as the low-coupling transformer 300 of FIG. 3; when the port 3 switch 90 is in the configuration of FIG. 2 (turned on), the tertiary winding operates as the regular transformer 200.

The transformer 100 thus enables two possible signal links between port 1 and either port 2 or port 3. The port 2 switch 80 and port 3 switch 90 are each connected to the inside nodes of the transformer to control the transformer current flow. The switches may control the coupling coefficient between/among transformer ports. Further, the transformer 100 is in a compact three-port form. Combined with the capability of the switch to force one port into high isolation mode, the transformer achieves a directional coupling from the primary port to one of the secondary ports.

In some embodiments, when the port 2 switch 80 is turned on, the port 3 switch 90 is turned off, and vice-versa. When the port 2 switch 80 is turned on, power from port 1 flows to port 2 and, since the port 3 switch 90 is turned off, no power flows to port 3. This low-coupling of the tertiary does not mean that power is lost to heat, simply that there is no coupling of power from the primary to the tertiary.

Three-port transformers have been in the literature to perform antenna sharing and transmit/receive switch design. But none of the known three-port transformers perform control inside the transformer, nor do they employ the above-described coupling cancellation to achieve port isolation.

In some embodiments, the voltage swing across the port 2 and port 3 switches 80, 90 of the transformer 100 is only half of that at the corresponding port. As a result, in some embodiments, low-voltage switches and fewer switches may be used to meet the reliability requirement, relative to those that would be required for typical transformers. Using fewer and low-voltage switches leads to less switch loss, in some embodiments. As integrated circuit technology advances, the breakdown voltage of the transistor becomes lower, making the architecture 100 more attractive.

The switchable transformer architecture 100 of FIG. 1 may be applied to build RF front-end circuits by combining transformers and transmit/receive (TR) switches. To operate in an RF front-end, for example, the transformer 100 (FIGS. 7 and 8) may have port 1 connected to an antenna 75, port 2 connected to a transmitter 95 (receiver 85), and port 3 connected to a receiver 85 (transmitter 95). Using the principles described above, by selectively operating the switches 80, 90, the transmitter 95 may be turned on (off) while the receiver 85 is turned off (on).

Figure 5:
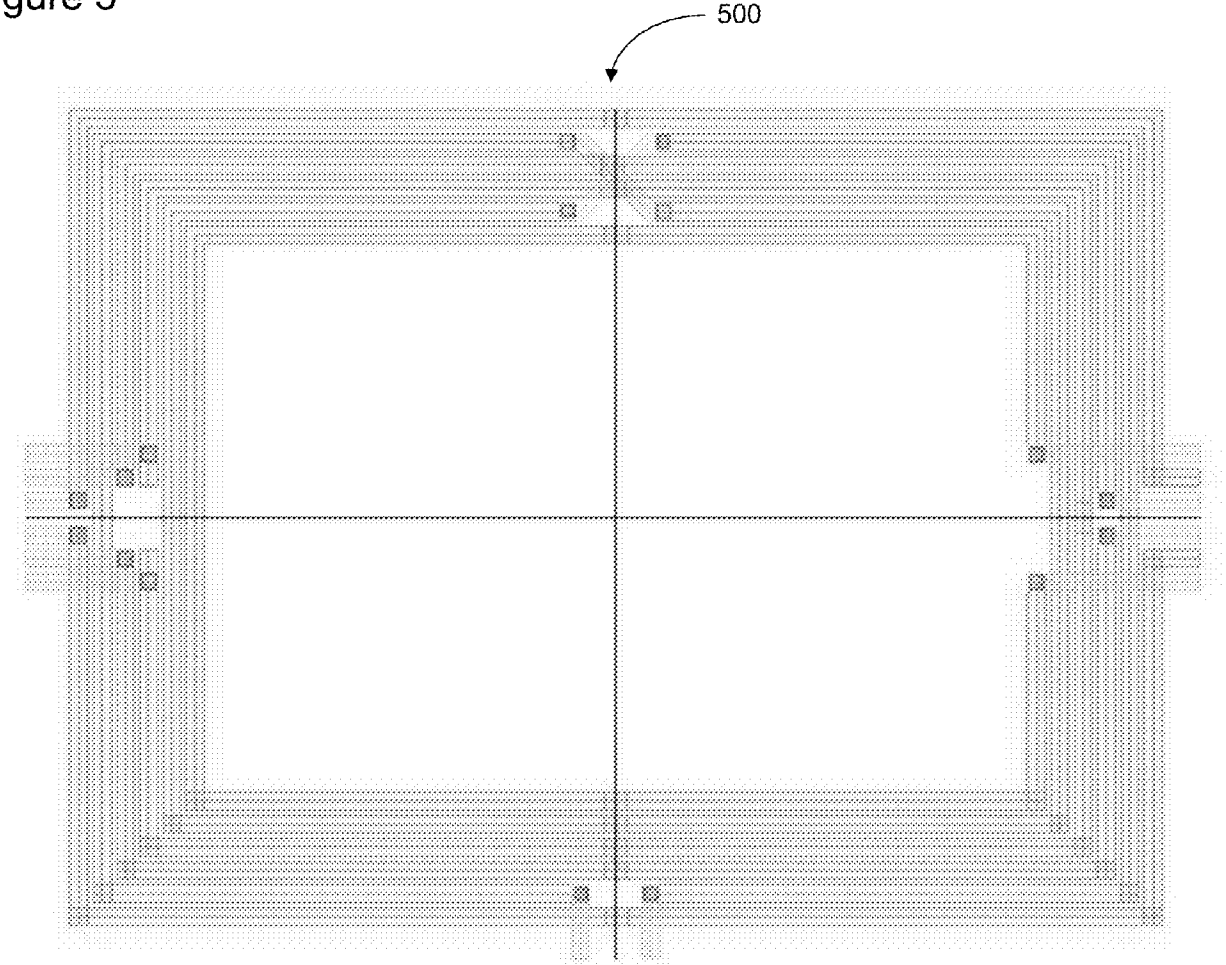
FIGS. 5 and 6 depict a layout of a transformer having the properties of the switchable transformer of FIG. 1, according to some embodiments.
Figure 6:
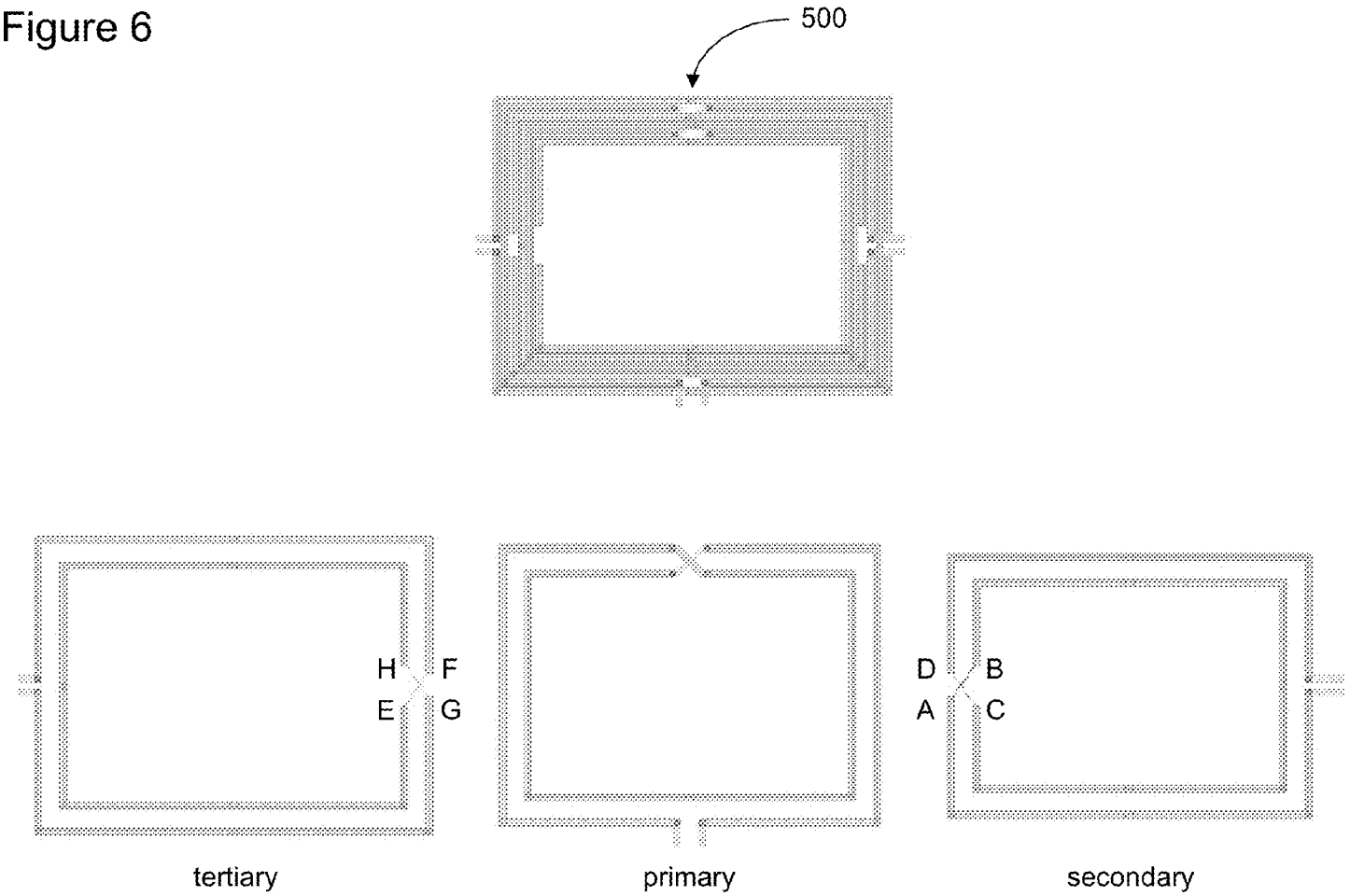

FIGS. 5 and 6 depict a switchable transformer layout 500, according to some embodiments. In FIG. 6, the transformer 500 is separated into the primary winding, the secondary winding, and the tertiary winding.

Transformers having switches is nothing new, but the transformer 100 is unique because the switches are embedded between turns of the secondary and tertiary windings, not outside the transformer. Any transformer winding may be treated as four connected segments. In some embodiments, switches are placed at four positions: the end of the first segment, the start of the second segment, the end of the third segment, and the start of the fourth segment. In a normal high-coupling transformer configuration, the switches connect the end of the first segment to the start of the second segment, and connect the end of the third segment to the start of the fourth segment. The coupled current in each segment flows in the same direction along the winding so that power is transferred to this winding.

Figure 7:
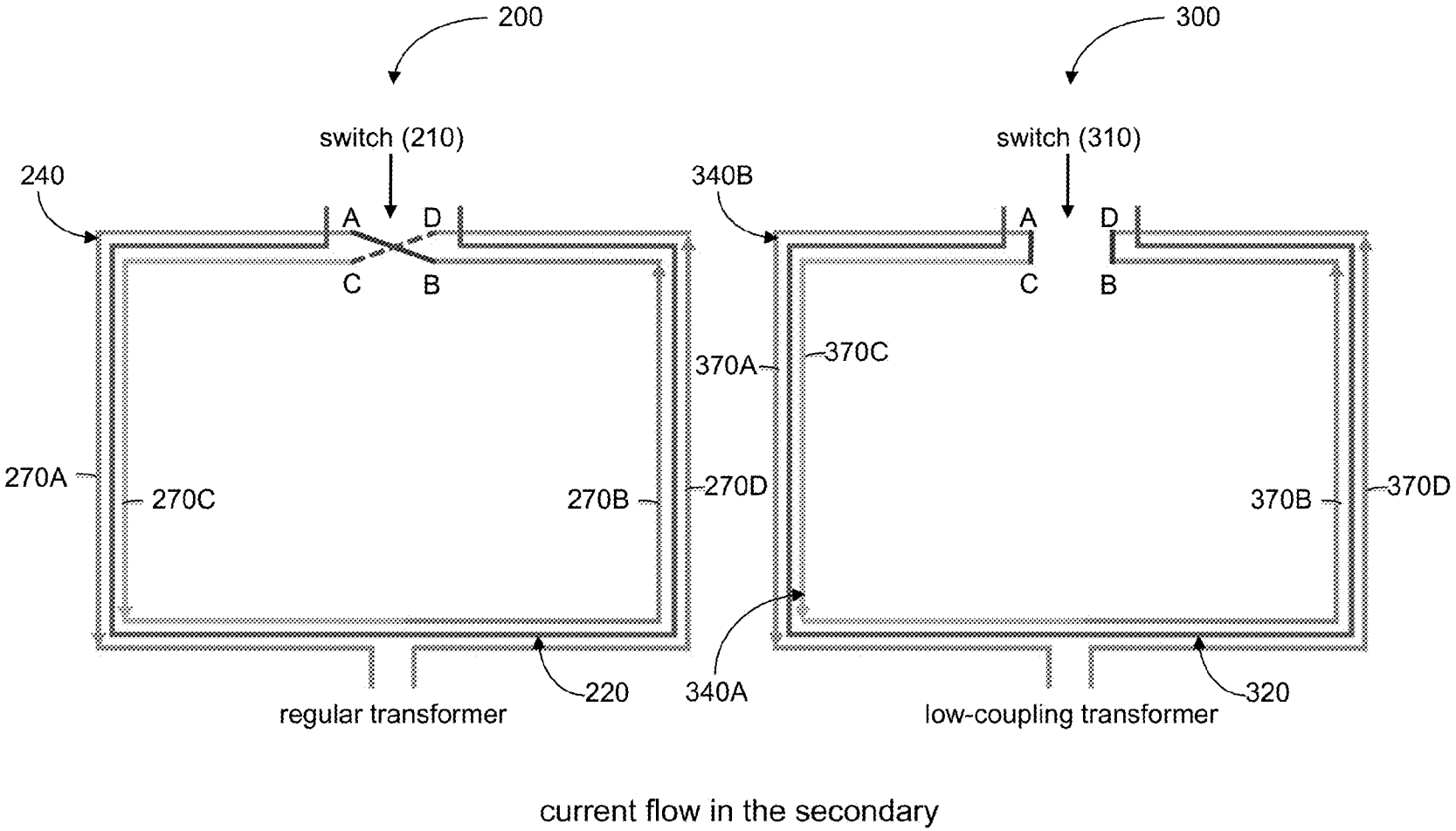
FIG. 7 is a diagram of the regular and low-coupling transformers of FIG. 3, with sections of the transformer color-coded into segments, according to some embodiments.
Figure 8:
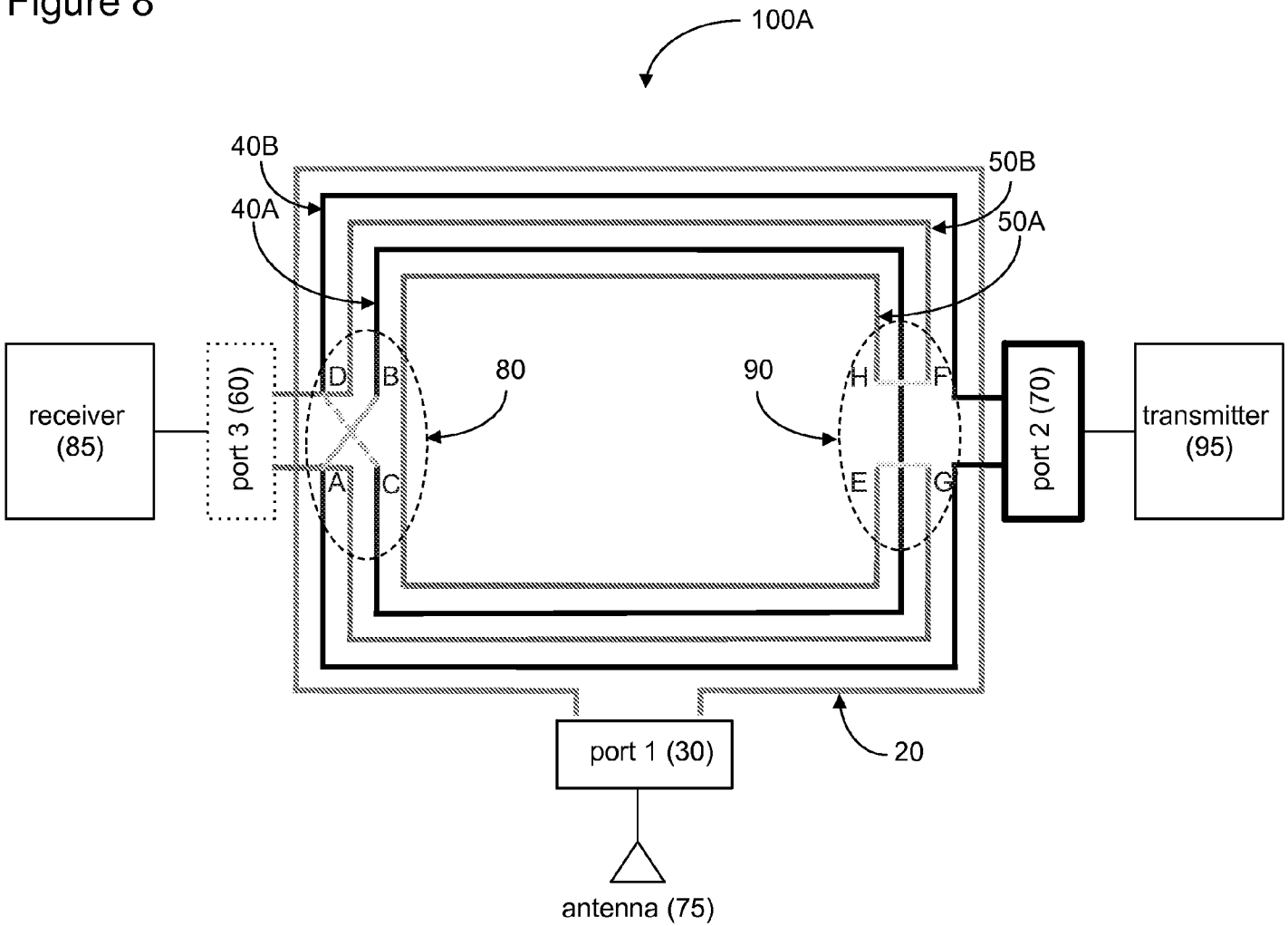
FIGS. 8 and 9 are schematic diagrams of the switchable transformer of FIGS. 1 and 2, respectively, connected to a receiver, a transmitter, and an antenna, according to some embodiments.
Figure 9:
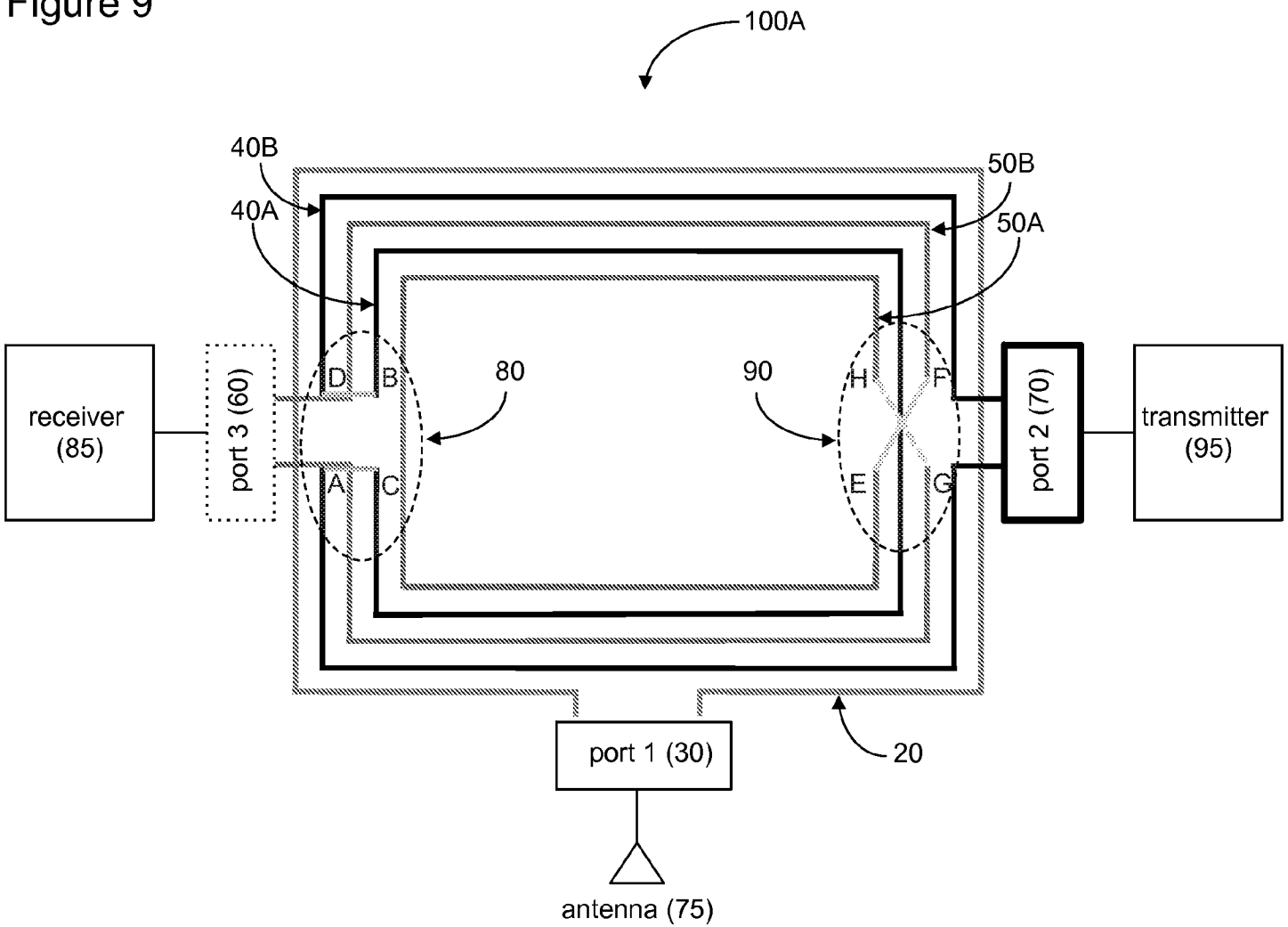

FIG. 7 shows the regular and low-coupling transformers 200, 300 of FIG. 3, this time with the segments making up the transformer winding color-coded to illustrate the arrangement. The secondary winding 240 of the regular transformer 200 may be thought of as having four segments 270A, 270B, 270C, and 270D. The end of the first segment 270A (orange) is connected at the switch 210 to the beginning of the second segment 270B (magenta). The end of the second segment 270B (magenta) is connected to the beginning of the third segment 270C (cyan). The end of the third segment 270C (cyan) is connected, via switch 210, to the beginning of the fourth segment 270D (lime green).

In a low-coupling configuration, the switches connect the end of the first segment to the end of the third segment, and connect the start of the second segment to the start of the fourth segment. The coupled currents in the first segment and the fourth segment flow in the opposite direction of those in the second and the third segments, so that overall coupled current is about zero. The configuration results in minimum power being transferred to the winding. Although it is preferable to make the four segments the same length to achieve better isolation when the transformer is in the low coupling configuration, the length may be of different lengths for other benefits, such as achieving a low voltage swing across the switches.

Again, this arrangement is depicted in FIG. 7, according to some embodiments. The secondary winding 340 of the low-coupling transformer 300 may be thought of as having four segments 370A, 370B, 370C, and 370D. The end of the first segment 370A (orange) is connected at the switch 310 to the end of the third segment 370C (cyan). The end of the second segment 370B (magenta) is connected to the beginning of the third segment 370C (cyan). The beginning of the second segment 370B (magenta) is connected to the beginning of the fourth segment 370D (lime green).

As an example, the proposed architecture is implemented in a TSMC 65 nm CMOS process (CMOS being short for complementary metal-oxide semiconductor). The layout is shown in FIGS. 5 and 6, according to some embodiments, with all three inductors being in a two-turn form. The metals are 6 μm wide and the space is 2 μm. The switching nodes (A-H) are brought either to the left or to the right of the transformer. Assuming ideal switches, the coupling coefficient (k) and the power gain (port 1 to port3/port 2), based on electromagnetic simulation, are listed in Table 1, below. Table 1 shows both loss and high isolation.

TABLE 1

Coupling coefficient (k) and power gain

| | port 2 on | port 3 on |
|---|---|---|
| k (port 1 to port 2) | 0.81 | 0.1 |
| k (port 1 to port 3) | 0.04 | 0.80 |
| power gain (dB) (port 1 to port 2) | −1.2 | −24 |
| power gain (dB) (port 1 to port 3) | −33 | −1.3 |

The real transistor switches are used to investigate the performance. All three ports are assumed to have a 50-ohm load. Since the voltage swing across all switches is half of the voltage swing at the ports, only low-voltage transistors are needed, in some embodiments. At certain nodes, two serial transistors are used to improve linearity. The results at 2.5 GHz are summarized in Table 2, below.

TABLE 2

Power gain and port 2 P1dB with real transistors

| | port 2 on | port 3 on |
|---|---|---|
| power gain (dB) | −1.7 | −1.9 |
| P1dB at port 2 (dBm) | 26 | N/A |

In current solutions, transformers and switches are separated. Usually multiple transformers and switches are needed to share the port 1. In a system with large output power, such as WiFi, multiple switches are implemented to meet the reliability requirement, which leads to large signal loss.

The above switchable transformer architecture combines the transformer and switch design. The switch controls the signal flow inside the transformer so that high isolation is achieved through coupling cancellation. And because the switch is inside the transformer, the switch does not see the full voltage swing at the transformer input. The result is relaxed reliability requirement on switches, which leads to less switch loss since fewer switches are needed and thus a low-voltage transformer may be used.

FIG. 5 is an actual layout of a switchable transformer 500, as described above, according to some embodiments. The transformer 500 includes a two-turn primary inductor and two two-turn secondary inductors. The switching nodes are brought out of the transformer without connection. The switching transformers may be put there to control the transformer.

The switchable transformer 100 may be used in general integrated circuit processing as well as in a wide range of products implementing transformers and radio frequency switching circuits.

While the application has been described with respect to a limited number of embodiments, those skilled in the art will appreciate numerous modifications and variations therefrom. It is intended that the appended claims cover all such modifications and variations as fall within the true spirit and scope of the invention.

We claim:

1. A transformer, comprising:

a primary winding coupled to a first port;

a secondary winding coupled to a second port, the secondary winding comprising a first segment, a second segment, a third segment, a fourth segment, and a secondary winding switch, wherein:

the first segment comprises an $S1_A$ end and an $S1_B$ end, wherein the $S1_A$ end is coupled to the secondary winding switch and the $S1_B$ end is coupled to the second port;

the second segment comprises an $S2_A$ end and an $S2_B$ end, wherein the $S2_A$ end is coupled to the secondary winding switch;

the third segment comprises an $S3_A$ end and an $S3_B$ end, wherein the $S3_A$ end is coupled to the secondary winding switch and the $S3_B$ end is coupled to the $S2_B$ end of the second segment; and the fourth segment comprises an $S4_A$ end and an $S4_B$ end, wherein the $S4_A$ end is coupled to the secondary winding switch and the $S4_B$ end is coupled to the second port;

wherein the secondary winding switch is:

turned on when $S1_A$ is coupled to $S2_A$ and $S3_A$ is coupled to $S4_A$; and turned off when $S1_A$ is coupled to $S3_A$ and $S4_A$ is coupled to $S2_A$; and a tertiary winding coupled to a third port, the tertiary winding comprising four tertiary segments and a tertiary winding switch wherein the tertiary winding switch is disposed between the four tertiary segments;

wherein a current is induced in the secondary winding and minimal current is induced in the tertiary winding when the secondary winding switch is turned on and the tertiary winding switch is turned off.

2. The transformer of claim 1, wherein the current is induced in the tertiary winding and minimal current is induced in the secondary winding when the tertiary winding switch is turned on and the secondary winding switch is turned off.

3. The transformer of claim 1, wherein the first port is coupled to a source, and the source is an antenna.

4. The transformer of claim 1, wherein the second port is coupled to a first load and the first load is a transmitter.

5. The transformer of claim 1, wherein the third port is coupled to a second load and the second load is a receiver.

6. The transformer of claim 1, wherein the secondary winding switch is disposed at the $S1_A$ end of the first segment, the $S2_A$ end of the second segment, the $S3_A$ end of the third segment, and the $S4_A$ end of the fourth segment.

7. The transformer of claim 6, wherein the secondary winding switch is turned on when the $S1_A$ end of the first segment is coupled to the $S2_A$ end of the second segment and the $S3_A$ end of the third segment is coupled to the $S4_A$ end of the fourth segment.

8. The transformer of claim 1, wherein the tertiary winding comprises a fifth segment, a sixth segment, seventh a segment, and an eighth segment, wherein:

the fifth segment comprises an $S5_A$ end and an $S5_B$ end, wherein the $S5_A$ end is coupled to the tertiary winding switch;

the sixth segment comprises an $S6_A$ end and an $S6_B$ end, wherein the $S6_A$ end is coupled to the tertiary winding switch and the $S6_B$ end is coupled to the $S5_B$ end of the fifth segment;

the seventh segment comprises an $S7_A$ end and an $S7_B$ end, wherein the $S7_A$ end is coupled to the tertiary winding switch and the $S7_B$ end is coupled to the third port; and the eighth segment comprises an $S8_A$ end and an $S8_B$ end, wherein the $S8_A$ end is coupled to the tertiary winding switch and the $S8_B$ end is coupled to the third port.

9. The transformer of claim 8, wherein the tertiary winding switch is turned off when the $S5_A$ end of the fifth segment is coupled to the $S7_A$ end of the seventh segment and the $S6_A$ end of the sixth segment is coupled to the $S8_A$ end of the eighth segment.

10. A three-port transformer comprising:

a first port coupled to a primary winding, the primary winding comprising at least a single turn;

a second port coupled to a secondary winding, the secondary winding comprising at least two turns, an outer secondary turn and an inner secondary turn, wherein a secondary winding switch is disposed between the outer secondary turn and the inner secondary turn, the secondary winding switch further comprising a first connection point, a second connection point, a third connection point, and a fourth connection point, wherein:

the second connection point couples to the first connection point when the secondary winding switch is turned on;

the second connection point couples to the fourth connection point when the secondary winding switch is turned off;

the third connection point couples to the fourth connection point when the secondary winding switch is turned on;

the third connection point couples to the first connection point when the secondary winding switch is turned off;

wherein the first connection point does not ever couple to the fourth connection point, and the second connection point does not ever couple to the third connection point;

a tertiary port coupled to a tertiary winding, the tertiary winding comprising at least two turns, an outer tertiary turn and an inner tertiary turn, wherein a tertiary winding switch is disposed between the outer tertiary turn and the inner tertiary turn;

wherein the secondary winding has a high coupling coefficient with the primary winding when the secondary switch is turned on and the tertiary switch is turned off.

11. The three-port transformer of claim 10, wherein a signal transmitted from the first port is received by the second port and a second signal transmitted from the second port is received by the first port.

12. The three-port transformer of claim 10, wherein the tertiary winding has a high coupling coefficient with the primary winding when the tertiary switch is turned on and the secondary winding switch is turned off.

13. The three-port transformer of claim 11, wherein a signal transmitted from the first port is received by the third port and a second signal transmitted from the third port is received by the first port.

14. The three-port transformer of claim 10, wherein the first port is coupled to an antenna.

15. The three-port transformer of claim 10, wherein the second port is coupled to a transmitter.

16. The three-port transformer of claim 10, wherein the third port is coupled to a receiver.

17. A transformer, comprising:

a primary winding coupled to an antenna, the primary winding comprising N turns for integer N;

a secondary winding coupled to a transmitter, the secondary winding comprising 2N turns, wherein a secondary winding switch is coupled between an $N^{th}$ turn of the secondary winding and a $(N+1)^{th}$ turn; and a tertiary winding coupled to a receiver, the tertiary winding comprising 2N turns, wherein a tertiary winding switch comprising four connection points is coupled between an $N^{th}$ turn of the tertiary winding and a $(N+1)^{th}$ turn, the tertiary winding switch further comprising:

an on position in which a first connection point is coupled to a second connection point and a third connection point is coupled to a fourth connection point; and an off position in which the first connection point is coupled to the third connection point and the second connection point is coupled to the fourth connection point;

wherein the second connection point of the tertiary winding switch is never coupled to the fourth connection point;

wherein the transmitter is turned on and the receiver is turned off when the secondary winding switch is turned on and the tertiary winding switch is turned off.

18. The transformer of claim 17, the secondary winding switch further comprising four connection points, wherein:

the secondary winding switch is in an on position when a fifth connection point is coupled to a sixth connection point and a seventh connection point is coupled to an eighth connection point; and the secondary winding switch is in an off position when the fifth connection point is coupled to the seventh connection point and the sixth connection point is coupled to the eighth connection point;

wherein the sixth connection point of the secondary winding switch is never coupled to the eighth connection point.

19. The transformer of claim 17, wherein the secondary winding switch is turned off when the tertiary winding switch is turned on.

20. The transformer of claim 19, wherein the receiver is turned on and the transmitter is turned off.

* * * * *

UNITED STATES PATENT AND TRADEMARK OFFICE

CERTIFICATE OF CORRECTION

PATENT NO. : 8,519,814 B2
APPLICATION NO. : 13/250934
DATED : August 27, 2013
INVENTOR(S) : Lei Feng et al.

It is certified that error appears in the above-identified patent and that said Letters Patent is hereby corrected as shown below:

In the Claims

In column 7, line 29, in claim 1, delete "switch" and insert -- switch; --, therefor.

In column 7, line 56, in claim 8, delete "seventh a" and insert -- a seventh --, therefor.

Signed and Sealed this
Twelfth Day of November, 2013

Teresa Stanek Rea

Teresa Stanek Rea
*Deputy Director of the United States Patent and Trademark Office*